US011819097B2

(12) United States Patent
Woodring

(10) Patent No.: US 11,819,097 B2
(45) Date of Patent: Nov. 21, 2023

(54) UMBRELLA ASSEMBLY

(71) Applicant: Ryan P. Woodring, Martinsville, NJ (US)

(72) Inventor: Ryan P. Woodring, Martinsville, NJ (US)

( * ) Notice: Subject to any disclaimer, the term of this patent is extended or adjusted under 35 U.S.C. 154(b) by 0 days.

(21) Appl. No.: 17/964,362

(22) Filed: Oct. 12, 2022

(65) Prior Publication Data

US 2023/0284756 A1 Sep. 14, 2023

Related U.S. Application Data

(63) Continuation-in-part of application No. 17/482,876, filed on Sep. 23, 2021, now abandoned.

(60) Provisional application No. 63/140,335, filed on Jan. 22, 2021.

(51) Int. Cl.
*A45B 25/14* (2006.01)
*A45B 25/02* (2006.01)

(52) U.S. Cl.
CPC ..... *A45B 25/14* (2013.01); *A45B 25/02* (2013.01)

(58) Field of Classification Search
CPC ..... A45B 25/18; A45B 209/002; A45B 25/02; A45B 25/14; A45B 19/00; A45B 23/00
USPC ..... 135/25.41, 34.2
See application file for complete search history.

(56) References Cited

U.S. PATENT DOCUMENTS

| | | | | | |
|---|---|---|---|---|---|
| 3,435,836 | A * | 4/1969 | Sergio | A45B 25/24 | 135/22 |
| 3,534,752 | A * | 10/1970 | Sergio | A45B 19/00 | 135/22 |
| 3,709,238 | A * | 1/1973 | Leopoldi | A45B 25/24 | 135/25.41 |
| 3,844,301 | A * | 10/1974 | Harrell | A45B 19/00 | 135/33.5 |
| 4,788,996 | A * | 12/1988 | Forshee | A45B 25/02 | 135/25.41 |
| 4,971,088 | A * | 11/1990 | Lyng | A45B 9/02 | 135/65 |
| 5,188,137 | A * | 2/1993 | Simonelli | A45B 19/00 | 135/25.1 |
| 8,225,806 | B1 * | 7/2012 | Simonelli | A45B 25/14 | 135/34.2 |
| 9,468,273 | B1 * | 10/2016 | Hasselbach | A45B 25/143 | |
| 9,526,306 | B2 * | 12/2016 | Fitzgerald | A45B 25/22 | |
| 9,629,428 | B1 * | 4/2017 | Nei | A45B 25/18 | |
| 2009/0223545 | A1 * | 9/2009 | Beyer | A45B 19/00 | 135/31 |
| 2015/0237975 | A1 * | 8/2015 | Ng | A45B 19/00 | 135/27 |

* cited by examiner

*Primary Examiner* — Noah Chandler Hawk
(74) *Attorney, Agent, or Firm* — Gearhart Law, LLC

(57) ABSTRACT

An umbrella assembly is described in which a spring assisted movement of a knob away from or toward an umbrella handle respectively deploys or retracts a canopy and a plurality of support ribs. In the deployed position, each rib curves and keeps the canopy under tension. Elastic potential energy of a spring located within a body interior space deploys or retracts the ribs and canopy out of or into the body interior space, respectively.

11 Claims, 10 Drawing Sheets

UMBRELLA ASSEMBLY

CLAIM OF PRIORITY

This application claims priority to U.S. application Ser. No. 17/482,876 filed on Sep. 23, 2021 which claims priority to U.S. Application Ser. No. 63/140,355 filed on Jan. 22, 2021, the contents of both of which are herein fully incorporated by reference in its entirety.

FIELD OF THE EMBODIMENTS

The field of the invention and its embodiments relate to an improved umbrella assembly.

BACKGROUND

An umbrella or parasol is a folding canopy supported by wooden or metal ribs that is usually mounted on a wooden, metal, or plastic pole. An umbrella is designed to protect a person against environmental elements, such as rain, snow, or sunlight. Umbrellas may be both portable and stationary. Portable umbrellas may comprise light-weight materials and a minimum amount of structure for ease of transportation. However, such materials may result in the umbrella's moving parts being destroyed when exposed to unpredictable high winds to an extent that the umbrella is no longer usable. Moreover, some umbrellas are difficult to expand into an in-use and open position and to retract into a non-use and stored position. Thus, what is needed is an improved umbrella assembly that is configured to maintain the frame integrity of the umbrella and is also easy for a user to convert from a non-use position to an in-use position.

REVIEW OF RELATED TECHNOLOGY

U.S. Pat. No. 10,441,040 B2 describes an umbrella. The umbrella has a canopy, a main shaft, and a plurality of ribs pivotally attached to the main shaft. Each rib is of adjustable length and includes a pair of outer rib elements. The outer rib elements are flexible and normally adopt a straight configuration aligned with the main shaft in a closed position of the umbrella. In an open position of the umbrella, the outer rib elements flex so that outer ends of the outer rib elements extend generally circumferentially with respect to the canopy. The umbrella can have ribs that would normally be of one piece, in which case accommodation is made for an effective change in the radius of the ribs as the outer rib elements flex.

U.S. Pat. No. 10,182,627 B2 describes a sunshade apparatus, such as an umbrella or sunshade, that includes a canopy with extendable portions that may be positioned in a manner so as to maximize shade. The sunshade device includes a canopy and a rib assembly connected to a shaft. The rib assembly includes a first joint coupled to a first assembly arm. The first joint connects a first arm extension to the rib assembly at a first angle with respect to a surface. The rib assembly also includes a second joint is coupled to a second assembly arm. The second joint connects a second arm extension to the rib assembly at a second angle with respect to the surface.

U.S. Pat. No. 9,629,428 B1 relates to a sunshade apparatus, such as an umbrella or sunshade, that includes a canopy with extendable portions that may be positioned in a manner so as to maximize shade. The sunshade device includes a canopy and a rib assembly connected to a shaft. The rib assembly includes a first joint coupled to a first assembly arm. The first joint connects a first arm extension to the rib assembly at a first angle with respect to a surface. The rib assembly also includes second joint coupled to a second assembly arm. The second joint connects a second arm extension to the rib assembly at a second angle with respect to the surface.

U.S. Pat. No. 9,526,306 B2 describes an umbrella assembly. The umbrella assembly includes a housing for a canopy. The umbrella assembly has a mechanism powered to open and close the canopy. During opening, the canopy slides upward through the housing and extends outward in a blooming formation.

U.S. Pat. No. 9,468,273 B1 describes a retractable umbrella that includes a canopy with supporting ribs and a shaft with a handle located on a proximal end thereof. Inside the shaft resides an electric motor and a gearing mechanism for power transmission. When activated, the electric motor actuates the gearing mechanism to extend and retrieve the canopy from and into the shaft.

U.S. Pat. No. 9,526,306 B2 describes an umbrella assembly that includes a housing for a canopy. The umbrella assembly has a mechanism powered to open and close the canopy. During opening, the canopy slides upward through the housing and extends outward in a blooming formation.

GB 2525477 A describes a collapsible umbrella-like device comprising flexible ribs and a hollow storage tube. The device includes short restraining lines connected to the flexible ribs at one end and to a portion of the tube at their other end. When the ribs are pushed out of an open end of the tube, the restraining lines pull on the flexible ribs causing them to arc downwards. The device may comprise a reservoir for collecting rain that falls on the canopy. The canopy of the device may include photovoltaic cells or solar thermal collectors. Also disclosed is an umbrella-like device that makes use of a reel to control the extension of two or more flexible shafts.

WO 2006/048026 A1 relates to a folding umbrella comprising: a longitudinal tube shaft which contains the entire umbrella mechanism therein, a system of flexible rods which are fixed in place using wires that are anchored inside the tubular shaft, a polygonal piece of fabric which is supported by the flexible rod system and which forms a small protective awning in the extended position, an elastic element which guides the fabric when the umbrella is being closed, a mechanism comprising grooved and perforated stop elements, springs and coils which enable the entire system to be correctly extended and compressed and which are used to maintain the umbrella in the open position, a cord enabling the umbrella closure mechanism to be correctly actuated and the umbrella to be transported, a tube closure device which is designed to house the umbrella in the folded position, and a system fastening/release hook.

U.S. Published Patent Application No. 2009/0223545 A1 relates to an umbrella system, substantially comprising an umbrella with elements that include a hollow shaft, a cover, as well as a frame consisting of ribs and stretchers mounted on the exterior of the hollow shaft. When retracted, the cover is stowed inside the shaft. When deployed, the umbrella's cover is supported by ribs and stretchers as well as by the shaft. Ribs and stretchers slide along the hollow shaft's exterior as the invention's cover is deployed and retracted.

U.S. Pat. No. 8,225,806 B1 describes an umbrella having housing with a deployable canopy extendable and retractable therefrom. The canopy comprises a material covering supported by flexible ribs and rib extension retainer cords. The umbrella further provides an adjustable strap extending between the exterior distal ends and a handle on one distal end of a flexible collapsible material. The adjustable strap further provides a D-ring and clasp on one end allowing for removal of said strap.

Various umbrellas exist. However, their means of operation are substantially different from the present disclosure, as the other inventions fail to solve all the problems taught by the present disclosure.

SUMMARY

The present invention and its embodiments relate to an improved umbrella assembly.

A first embodiment of the invention describes an umbrella assembly. The umbrella assembly generally comprises a canopy, a handle, and a frame. The comprises an interior side disposed opposite an exterior side. The exterior side of the canopy comes into contact with an environmental condition, such as rain. As such, a material of the canopy may be a water or weather resistant material, such as a nylon material or a polyester material.

The frame of the umbrella assembly is affixed between the canopy and the handle. In some examples, the handle may comprise a non-slip material. In other examples, the handle may comprise a portion of non-slip material. The frame has a first end disposed opposite a second end. Moreover, a body portion is located between the first end and the second end of the frame. The first end of the frame comprises an opening and the second end of the frame engages the handle.

The body portion of the frame includes an inner hollow surrounded by an outer. The inner hollow of the frame is configured to house numerous components that are used for the functioning of the umbrella assembly, such as: a spring, a set of ribs, a seat, a support rod, and/or a base, among others not explicitly listed herein.

The spring has a first end disposed opposite a second end, where the second end is affixed to the base proximate the second end of the frame. The base is substantially planar in shape. In some examples, the spring is an extension spring. In other examples, the spring is a compression spring. However, it should be appreciated that the spring is not limited to these examples, as such examples are provided for illustrative purposes only.

Each rib of the set of ribs has a first end disposed opposite a second end. The first end of each rib is affixed to the interior side of the canopy. The first end of a first subset from the set of ribs are affixed to a first location along a periphery of the interior side of the canopy. Further, the first end of a second subset from the set of ribs are affixed to a second location on the interior side of the canopy. It should be appreciated that the first location differs from the second location. Moreover, the second location is proximate a center of the canopy as compared to the first location. Further, it should be appreciated that in some examples, the first end of each rib of the set of ribs may be curved in a horn shape (i.e., similar to the shape of a shoe horn) to allow for easy retraction into the inner hollow of the frame. A material of each rib of the set of ribs may be a metal material, a fiberglass material, or a plastic material, among other materials not explicitly listed herein. In contrast to traditional systems, the instant invention requires no string/restraining line to move the set of ribs.

In some examples, the seat is substantially cylindrical in shape. The seat has a first side disposed opposite a second side. The first side of the seat is configured to receive the second end of each rib of the set of ribs. The second side of the seat is affixed to the first end of the spring.

The support rod has a first end disposed opposite a second end. The first end of the support rod is coupled to the interior side of the canopy. The second end of the support rod is coupled to the first side of the seat.

A manual mechanism to open and close the umbrella assembly is also described. A wall of the frame comprises a slit through which planar portion of a knob passes. The planar portion is located partially within the body interior space and extends to the knob outside of the frame. The planar portion is affixed to the seat such that a force exerted on the knob in a direction away from the handle (e.g., an upward direction) moves each rib of the set of ribs from the closed position within the interior space of the frame to the open position at a location outside of the frame. This movement also moves the canopy from inside the interior space of the frame to a position outside of the frame. An elastic potential energy of the spring retracts each rib of the set of ribs and the canopy into the interior space of the frame.

In some examples, the knob comprises a lock that may lock the knob in the open position or the closed position. In other examples, the umbrella may include a hook that may be configured to engage the first end of the spring in an event that the lock becomes accidentally disengaged or fails to function as expected.

In some examples, the body portion of the frame may comprise one or more openings (or vent holes) disposed therethrough to allow the canopy to dry after being used in wet weather.

DETAILED DESCRIPTION

Figure 1:
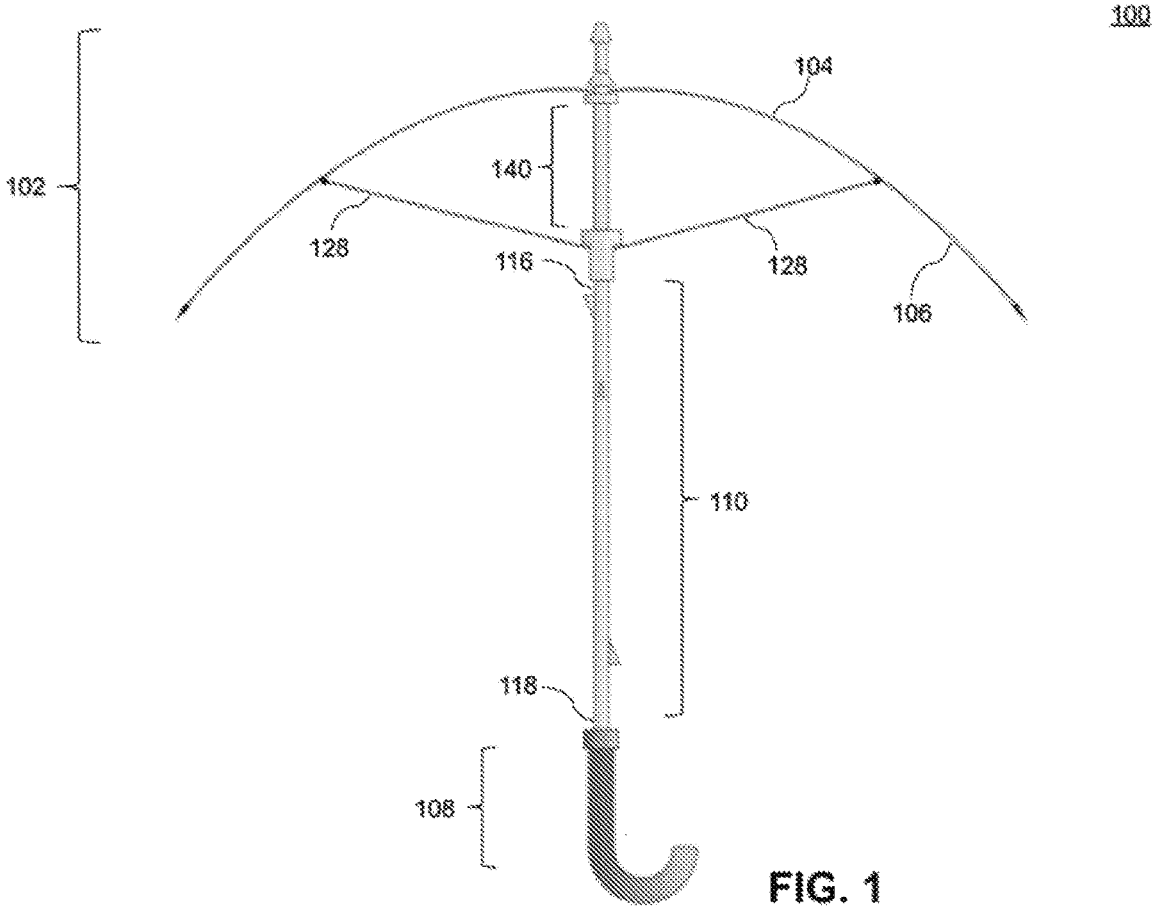
FIG. 1 depicts a schematic diagram of an umbrella assembly, according to at least some embodiments disclosed herein.

Embodiments of the present invention will now be described with reference to the drawings, in which identical elements in the various figures are identified with the same reference numerals. These embodiments are examples provided by way of explanation of the principles of the present invention, which is not intended to be limited thereto. Rather, the scope of the claims is defined not by the example embodiments, but by the claims. In fact, those of ordinary skill in the art may appreciate upon reading the present specification and viewing the present drawings that various modifications and variations can be made to the example embodiments.

As used herein, the singular forms "a," "an," and "the," are intended to include the plural forms as well, unless the context clearly indicates otherwise.

The phrase "and/or," as used herein in the specification and in the claims, should be understood to mean "either or both" of the elements so conjoined, i.e., elements that are conjunctively present in some cases and disjunctively present in other cases. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A): in yet another embodiment, to at least one, optionally including more than one, A, and at least one, optionally including more than one, B (and optionally including other elements); etc.

It will be further understood that the terms "comprises," "comprising." "includes," and/or "including," when used herein, specify the presence of stated features, integers, steps, operations, elements, and/ors, but do not preclude the presence or addition of one or more other features, integers, steps, operations, elements, s, and/or groups thereof.

Figure 3:
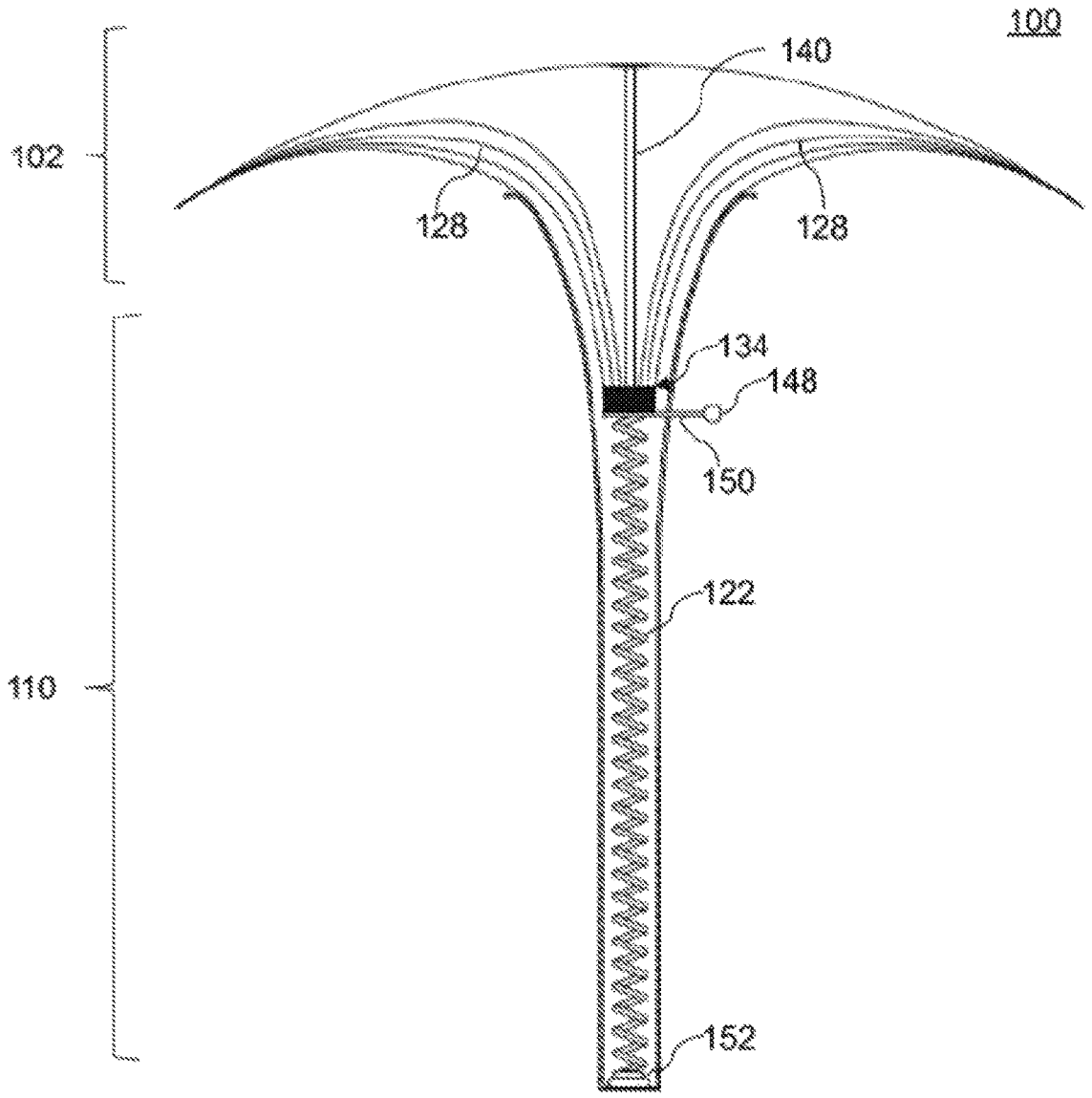
FIG. 3 depicts a schematic diagram of an interior of an umbrella assembly, according to at least some embodiments disclosed herein.
Figure 4:
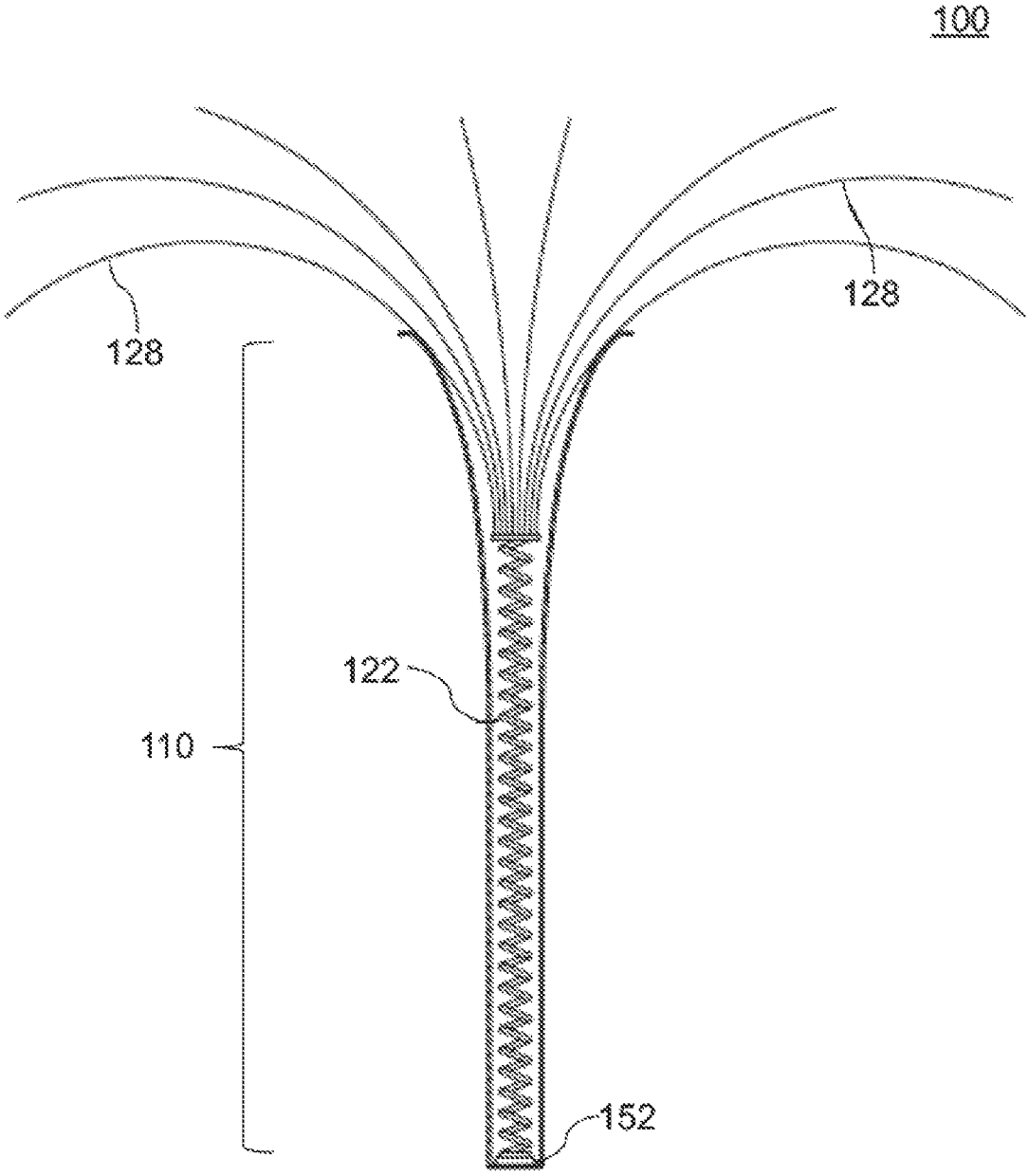
FIG. 4 depicts a schematic diagram of a spring and a set of ribs of an umbrella assembly, according to at least some embodiments disclosed herein.

An umbrella assembly 100 is described and depicted herein in at least FIG. 1, FIG. 3, and FIG. 4. As shown in at least FIG. 1, the umbrella assembly 100 generally comprises a canopy 102, a handle 108, and a frame 110. The frame 110 allows for the containment, storage, protection and mobility of the several components of the umbrella assembly 100, which will be discussed in turn.

The canopy 102 comprises an interior side 106 disposed opposite an exterior side 104. The exterior side 104 of the canopy 102 comes into contact with a weather event, such as rain. As such, a material of the canopy 102 may be a water repellent or otherwise weather resistant material, such as a nylon material or a polyester material. Though materials comprising the canopy 102 have been explicitly listed herein, such listing is for illustrative purposes only and other materials are contemplated.

The frame 110 is affixed between the canopy 102 and the handle 108. The handle 108 may be of any shape and the handle 108 is not limited to a curved shape as shown in FIG. 1. In some examples, the handle 108 may comprise a non-slip material. In other examples, the handle 108 may comprise a portion of non-slip material.

Figure 2:
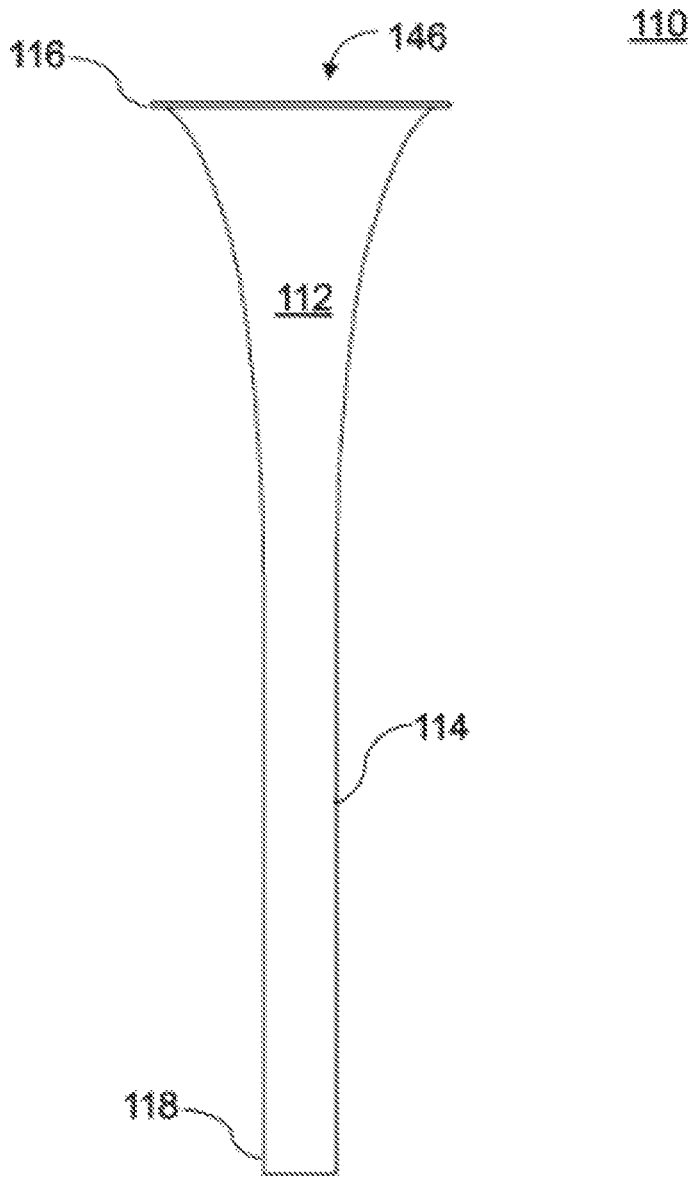
FIG. 2 depicts a schematic diagram of a frame of an umbrella assembly, according to at least some embodiments disclosed herein.

As shown in FIG. 1 and FIG. 2, the frame 110 has a first end 116 disposed opposite a second end 118. Moreover, a body portion is located between the first end 116 and the second end 118 of the frame 110. As shown in various figures, the first end 116 of the frame 110 flares outward. However, the shape of the frame 110 is not limited to any particular shape. The first end 116 of the frame 110 comprises an opening 146 into a body interior space 112. The second end 118 of the frame 110 engages the handle 108.

As shown in FIG. 2, a body of the frame 110 includes a body interior space 112 and an outer surface 114. The interior space 112 of the body is configured to house numerous components that are used for the functioning of the umbrella assembly 100, such as: a spring 122 (of FIG. 3, FIG. 4, FIG. 5, FIG. 6, FIG. 7, and FIG. 8), a set of ribs 128 (of FIG. 1, FIG. 3, FIG. 4, FIG. 5, and FIG. 6), a seat 134 (of FIG. 3 and FIG. 7), a support rod 140 (of FIG. 1, FIG. 3, and FIG. 9), and/or a base 152 (of FIG. 3, FIG. 4, FIG. 7, and FIG. 8), among others not explicitly listed herein.

Referring now to FIG. 3, the spring 122 has a first end disposed opposite a second end, where the second end is affixed to the base 152 proximate the second end 118 of the frame 110. The base 152 is substantially planar in shape and may comprise any geometric shape. In some examples, the spring 122 is an extension spring. In other examples, the spring 122 is a compression spring. It should be appreciated that the spring 122 may be another type of spring not explicitly listed herein.

Each rib 128 of a set of ribs has a first end disposed opposite a second end. The first end of each rib 128 is affixed to the interior side 106 of the canopy 102. The first end of a first subset of the ribs are affixed to a first location along a periphery of the canopy 102. Further, the first end of a second subset of the ribs are affixed to a second location different from the first location on the interior side 106 of the canopy 102. Moreover, the second location is closer to a center of the canopy 102 as compared to the first location. As such, the second subset from the set of ribs 128 may be shorter in length than the first subset from the set of ribs 128. Further, it should be appreciated that in some examples, the first end of each rib 128 may be curved into a horn shape (e.g., similar to the shape of a shoe horn) to allow for easy retraction into the body interior space 112 of the frame 110. Each rib 128 may be or comprise a flexable material such as a flexible metal material, fiberglass material, plastic material, or one or more other flexible materials not explicitly listed herein. Unlike traditional systems that require use of a string/restraining line to pull on their ribs (e.g., the set of ribs 128) to cause them to arc downwards, the instant invention requires no such string/restraining line.

In some examples, the seat 134 is substantially cylindrical in shape. The seat 134 has a first side disposed opposite a second side. The first side of the seat 134 is configured to receive the second end of each rib 128. The second side of the seat 134 is affixed to the first end of the spring 122.

A support rod 140 has a first end disposed opposite a second end and is substantially cylindrical in shape. The first end of the support rod 140 is coupled to the center of the interior side 106 of the canopy 102. The second end of the support rod 140 is coupled to the first side of the seat 134.

A fully manual or spring assisted mechanism is used to open and close the umbrella assembly 100. The outer surface 114 of the frame 110 comprises a knob 148 that passes through a slit in the body wall and is affixed to a planar portion 150. The planar portion 150 is located perpendicular to the frame 110. The planar portion 150 is located partially within the body interior space 112 of the frame 110 and extends to a location outside of the frame 110.

Figure 8:
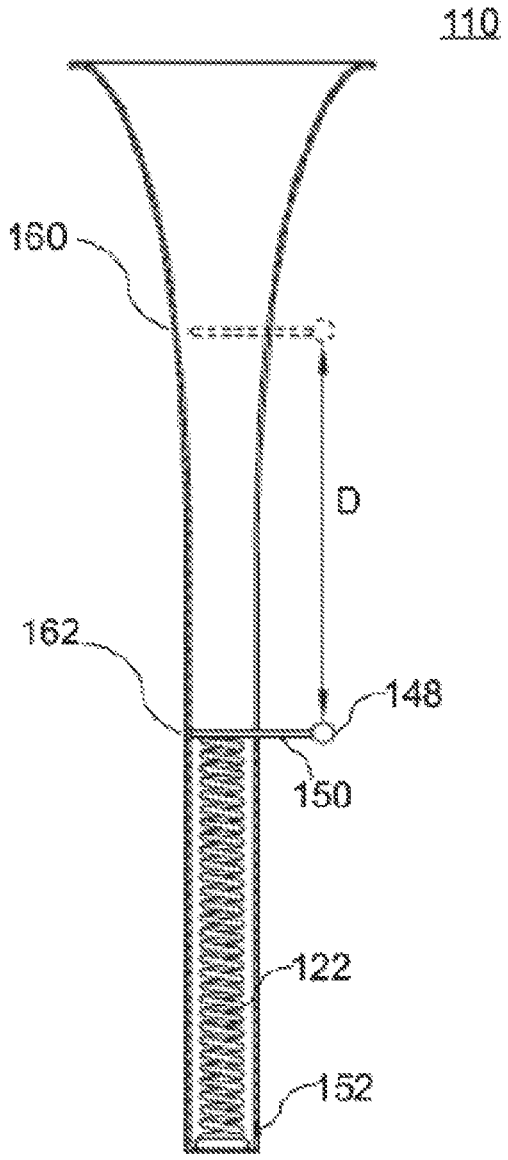
FIG. 8 depicts a schematic diagram depicting movement of a knob of an umbrella assembly from an open and in-use position to a closed and non-use position, according to at least some embodiments disclosed herein.

As shown in FIG. 3, the planar portion 150 is affixed to the seat 134. FIG. 8 illustrates and suggests that a force exerted on the knob 148 by the user in a direction away from the handle 108 (i.e., in an upward direction) from a first location 162 to a second location 160 moves each rib 128 of the set of ribs from the closed position within the body interior space 112 of the body portion of the frame 110 to the open position such that each rib of the set of ribs 128 and the canopy 102 are moved to a location outside of the frame 110. The open or in-use position of the canopy 102 may also be referred to herein as a blooming formation or configuration. It should be appreciated that the force exerted on the knob 148 in the upward direction away from the handle 108 results in the deployed or open position, in which the spring 122 is extended.

When a lock/mechanism is not used or is disengaged, an external force exerted by the user is not needed to bring the spring 122 from the second location 160 to the first location 162 (moving each rib of the set of ribs 128 from a deployed or open position to a retracted or closed position by retracting the ribs 128 and the canopy 102 into the body interior space 112. In fact, in an embodiment the elastic potential energy of the spring 122 draws each rib of the set of ribs 128, as well as the canopy 102, back into the body interior space 112. As described herein, "elastic potential energy," is potential energy stored as a result of deformation of an elastic object, such as the stretching of the spring 122. The elastic potential energy is equal to the work done to stretch the spring 122, which depends upon the spring 122 constant k, as well as the distance stretched. According to Hooke's law, the force required to stretch the spring will be directly proportional to the amount of stretch. The force has the form $F=-kx$, where the work done to stretch the spring a distance x is $\text{Work}=\frac{1}{2}kx^2$. Thus, as shown in FIG. 8, the knob 148 moves a distance "D" between the open and in-use position to the closed and non-use position.

Figure 5:
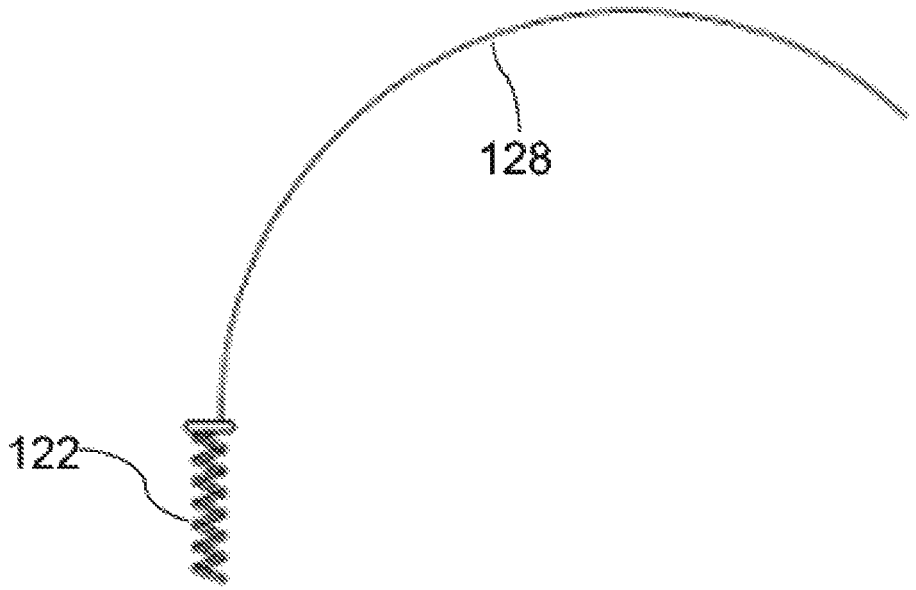
FIG. 5 depicts a schematic diagram of a shape of a rib of an umbrella assembly in an open and in-use position, according to at least some embodiments disclosed herein.
Figure 6:
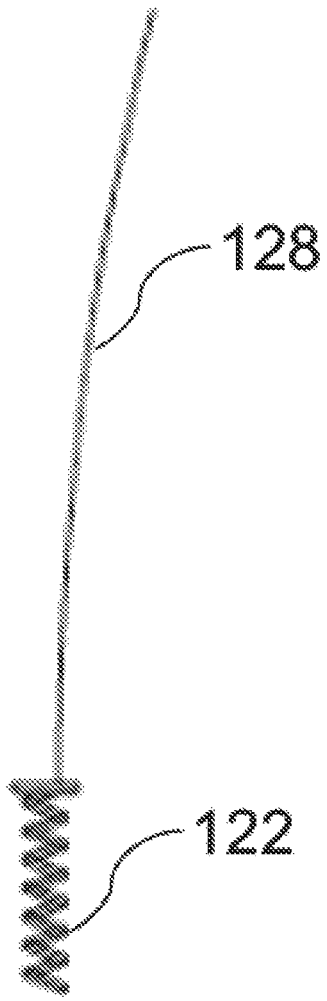
FIG. 6 depicts a schematic diagram of a shape of a rib of an umbrella assembly in a closed and non-use position, according to at least some embodiments disclosed herein.
Figure 7:
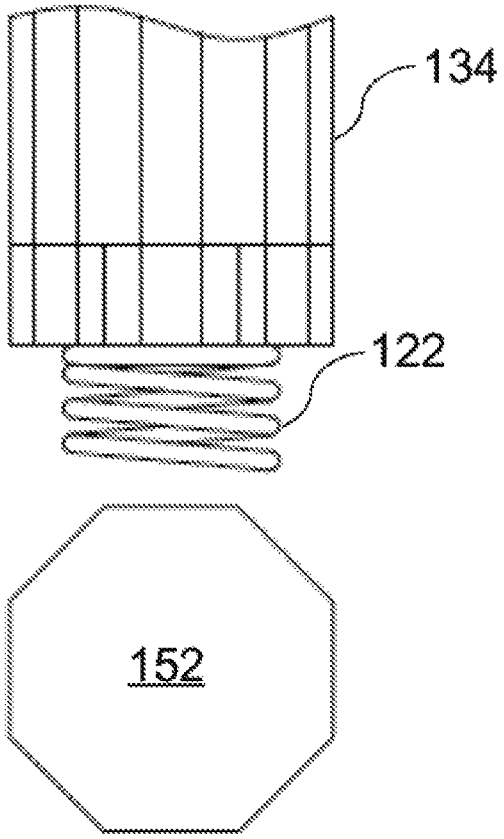
FIG. 7 depicts a schematic diagram of a base, a spring, and a seat of an umbrella assembly, according to at least some embodiments disclosed herein.

It should be appreciated that typical prior art collapsible/foldable umbrellas require use of a string/restraining line to pull on flexible ribs to cause them to arc downwards. In contrast, the instant invention requires no such string/restraining line. In fact, in the open and in-use position, a natural shape of the first end of each rib of the set of ribs 128 is a curved shape, as shown in FIG. 5. Further, in the instant invention, each rib 128 has a bending resistance such that when each of the set of ribs 128 is retracted into the body interior space 112, a shape of each rib 128 is straightened into a straighter, or "planar" shape, as shown in FIG. 6. No pulley or string is needed by the instant invention for each of the ribs 128 to bend.

Figure 9:
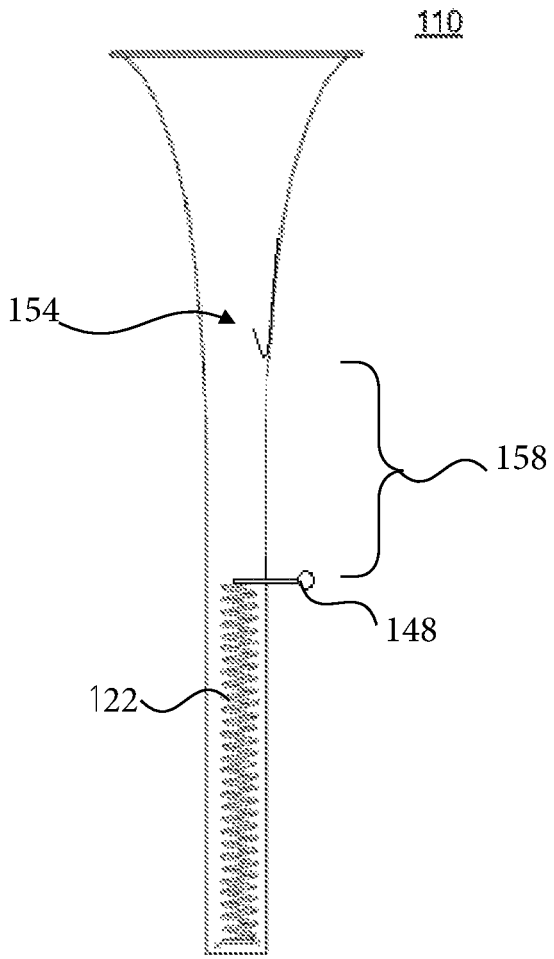
FIG. 9 depicts a schematic diagram of a hook affixed to a rod of an umbrella assembly, according to at least some embodiments disclosed herein.

In some examples, the knob 148 comprises a lock mechanism (not shown). The lock may be configured to lock the knob 148 in the deployed position or in the retracted position. In other examples, and as shown in FIG. 9, there may be a hook 154. The hook 154 may be configured to engage the first end of the spring 122 in an event that the lock becomes accidentally disengaged or fails to function as expected.

The hook 154 may be on either end of the slit 158 which permits movement of the knob 148. The hook would primarily be used on the bottom of the frame 110 for use with a compression spring to prevent ribs 128 from extruding from the frame 110. The hook 154 would primarily be used on the top portion of the frame 110 (as shown in FIG. 9) with the use of an extension spring 122 to prevent the ribs 128 retracting back into the frame 110 in the event of a failure of the knob 148.

Though a manual mechanism has been described, an automatic mechanism may also be used. In some examples, the mechanism may be partially or fully automated.

Figure 10:
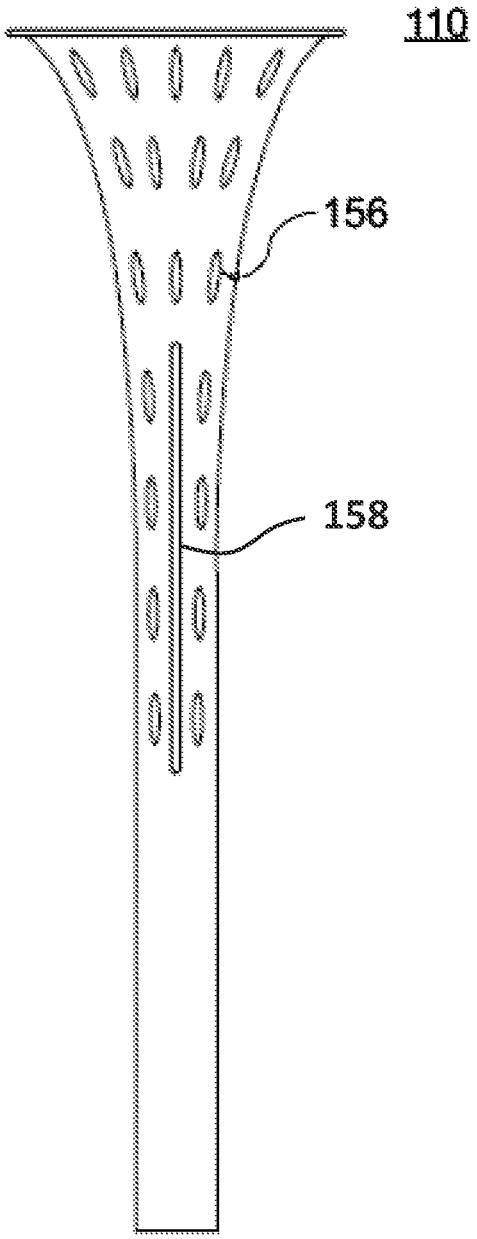
FIG. 10 depicts openings located in a frame body wall of an umbrella assembly, according to at least some embodiments disclosed herein.

In some examples, and as shown in FIG. 10, the body portion of the frame 110 may comprise a slit 158 through which the planar portion 150 of knob 148 passes, and one or more openings 156 (or vent holes) disposed therethrough to allow the canopy 102 to dry when the canopy 102 is in the closed or non-use position. In some examples, the one or more openings 156 may be randomly spaced. In other examples, the one or more openings 156 may be spaced in a repetitive pattern.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

Although embodiments of the invention have been described with a certain degree of particularity, it is to be understood that the present disclosure has been made only by way of illustration and that numerous changes in the details of construction and arrangement of parts may be resorted to without departing from the spirit and the scope of the invention as determined by the claims.

What is claimed is:

1. An umbrella comprising:

a canopy having an interior side disposed opposite an exterior side;

a handle; and a body affixed between the canopy and the handle, the body comprising:

a first end having an opening to a body interior space defined by a wall of the body;

a second end opposite the first end that engages the handle; and a spring inside the body interior space, the spring having a first end and a second end disposed opposite the first end, the second end affixed to a base proximate the second end of the body;

a plurality of ribs with each rib being comprised of a unitary construction of a single material and each rib having a first end affixed to the interior side of the canopy, and a second end disposed opposite the first end, wherein each of the plurality of ribs are not coupled to the canopy at any point other than the first end, and no restraining line is needed to pull on the ribs when closing the umbrella;

a seat having a first side configured to receive the second end of each of the ribs, and a second side coupled to the first end of the spring;

a support rod having a first end affixed to the center of the interior side of the canopy, and a second end opposite the first end affixed to the first side of the seat;

a slit traversing the wall of the body along a length of the body;

a hook element located on an inner surface of the body, wherein the hook element is configured to selectively engage a circular knob at a second end of the slit to prevent an extension spring from retracting when the plurality of ribs are extended outwards from the body; and the circular knob having a first end affixed to the second side of the seat and a second end disposed opposite the first end, the second end extending through the slit;

wherein a force exerted on the circular knob in a direction away from the handle stretches the spring and pushes the ribs and the canopy out of the body interior space to a deployed position; and wherein an elastic potential energy of the spring retracts the ribs and the canopy into the body interior space.

2. The umbrella of claim 1, wherein each rib is curved in the deployed position.

3. The umbrella assembly of claim 1, wherein as the ribs retract into the body interior space, the ribs resist being straightened into an undeployed position.

4. The umbrella assembly of claim 1, wherein the body comprises one or more openings through the body wall to allow the retracted canopy to dry.

5. The umbrella assembly of claim 1, wherein the handle comprises a slip-resistant material.

6. The umbrella assembly of claim 1, wherein the knob engages a lock configured to lock the knob in a deployed position or a retracted position.

7. The umbrella assembly of claim 1, wherein a material of the canopy is selected from the group consisting of: a nylon material and a polyester material.

8. The umbrella assembly of claim 1, wherein a material of each rib is selected from the group consisting of: a metal material, a fiberglass material, and a plastic material.

9. An umbrella consisting of:

a canopy having an interior side disposed opposite an exterior side;

a handle; and a body affixed between the canopy and the handle, the body comprising:

a first end having an opening to a body interior space defined by a wall of the body;

a second end opposite the first end that engages the handle, wherein the opening of the body has a diameter greater than that of the second end;

an extension spring inside the body interior space, the extension spring having a first end and a second end disposed opposite the first end, the second end directly affixed to a planar base on an interior surface of the second end of the body, and a plurality of openings of varying sizes traversing the wall of the body with the plurality of openings dispersed intermittently throughout the wall of the body;

a plurality of ribs, each rib being comprised of a unitary construction of a single material and each rib having a first end affixed to the interior side of the canopy, and a second end disposed opposite the first end, wherein each of the plurality of ribs are not coupled at any other point along the canopy and no restraining line is needed to pull on the ribs when closing the umbrella;

a cylindrical seat having a first side configured to receive the second end of each of the ribs, and a second side directly affixed to the first end of the extension spring;

a support rod having a first end affixed to the center of the interior side of the canopy, and a second end opposite the first end affixed to the first side of the seat;

a slit traversing the wall of the body along a length of the body with the slit traversing only the wall of the body and not any of the plurality of openings, wherein the slit comprises a first end and a second end; and a circular knob affixed to a planar portion, the planar portion having a first end affixed to the second side of the seat and a second end disposed opposite the first end and affixed to the circular knob, the second end extending through the slit in the wall of the body;

a hook element located on an inner surface of the body, wherein the hook element is configured to selectively engage the extension spring at a second end of the slit to prevent the extension spring from retracting when the plurality of ribs are extended outwards from the body;

wherein a force exerted on the circular knob in a direction toward the handle disengages the hook element and releases the extension spring and pulls the ribs and the canopy from a deployed position to a retracted position in the body interior space.

10. The umbrella of claim 9, wherein each rib is curved in the deployed position.

11. The umbrella assembly of claim 9, wherein as the ribs retract into the body interior space, the ribs resist being straightened into an undeployed position.

* * * * *